United States Patent [19]

Goldschild

[11] Patent Number: 4,940,088

[45] Date of Patent: Jul. 10, 1990

[54] SONDE FOR TAKING FLUID SAMPLES, IN PARTICULAR FROM INSIDE AN OIL WELL

[75] Inventor: Goldschild, Vulaines/Seins, France France

[73] Assignee: Schlumberger Technology Corporation, Houston, Tex.

[21] Appl. No.: 317,709

[22] Filed: Mar. 1, 1989

[30] Foreign Application Priority Data

Mar. 3, 1988 [FR] France ..... 88 02680

[51] Int. Cl.[5] ..... E21B 49/08; G01N 1/14

[52] U.S. Cl. ..... 166/109; 166/162; 166/264; 73/863.84; 73/864.34; 73/864.62

[58] Field of Search ..... 166/162, 166, 69, 264, 166/107, 109, 110, 108; 73/863.24, 864.62, 863.85, 864.34

[56] References Cited

U.S. PATENT DOCUMENTS

| | | | |
|---|---|---|---|
| 2,862,561 | 12/1958 | Teubner | 166/264 |
| 3,055,764 | 9/1962 | Pryor et al. | 166/109 |
| 3,095,930 | 7/1963 | Kisling | 166/163 |
| 3,358,755 | 12/1967 | Chisholm | 166/3 |
| 3,459,263 | 8/1969 | Drivet | 166/165 |
| 3,981,189 | 9/1976 | Howard et al. | 166/264 |
| 4,372,382 | 2/1983 | Rooney et al. | 166/264 |
| 4,744,255 | 5/1988 | Jaeger | 73/863.84 |

FOREIGN PATENT DOCUMENTS 0148696 7/1985 European Pat. Off. .

*Primary Examiner*—Bruce M. Kisliuk
*Attorney, Agent, or Firm*—Henry N. Garrana

[57] ABSTRACT

In order to take a practically unlimited number of fluid samples, in particular from a well in production, a sonde is used including as many modular sampling devices (10) as there are samples to be taken. These devices (10) are disposed end-to-end and they are actuated in succession by a central control rod (66) driven back-and-forth by an actuator device situated at the top end of the sonde. A bottom end piece puts the bottom sampling device into a ready position in which it is ready to be actuated by raising the rod (66). By taking a sample in this way, the bottom sampling device also serves to put the adjacent sampling device into its ready position, and so on all the way up to the topmost sampling device.

15 Claims, 6 Drawing Sheets

SONDE FOR TAKING FLUID SAMPLES, IN PARTICULAR FROM INSIDE AN OIL WELL

BACKGROUND OF THE INVENTION

The invention relates to a sonde designed, in particular, for taking a plurality of fluid samples in a single operation.

This sonde which is particularly adapted to taking samples of the fluids present down an oil well in production, is never the less not limited to that application. In particular, it may also be used for taking samples in the food industry and in the oceanographic industry.

Most existing sondes for taking fluid samples operate in accordance with the principles described in the U.S. Pat. No. 3,095,930.

In such prior sampling sondes, a liquid such as oil is initially inserted into a chamber provided for this purpose in the tubular body of the sonde, and it serves to keep a piston in a rest position. While the piston is in this position, no fluid is admitted into a sampling chamber which communicates with the outside via an orifice formed in the sonde body. A sample-taking operation is triggered by a remote control device which puts the chamber containing the liquid into communication with a chamber containing air at a pressure which is rather very low compared with the outside pressure, said air chamber being likewise provided in the sonde body. Depending on circumstances, the remote control device may be a pyrotechnical device, an electrically controlled valve, etc. A regulator, such as a choke, is placed between the chamber which initially contains the liquid and the chamber containing air so as to prevent the liquid from being transferred too quickly under the effect of the very high pressure normally to be found downhole.

The above description illustrates the complexity of existing sampling sondes, which gives rise in practice to relatively lengthy and tedious preparations and implementation. In particular, the chamber containing the liquid must be filled with care since any air inside this chamber would lead to an error in the volume of the sample taken and would consequently give rise to error in the analyses subsequently performed on that sample.

Proposals have also been made, in particular in the European patent application No. EP-A-0 148 696, to insert into a single well either a plurality of sampling sondes or else a sonde comprising a plurality of sampling devices so as to enable a plurality of samples to be taken during a single descent.

This is advantageous since it reduces the inactive time of the well when several samples need to be taken in succession. However, due to the complexity of the sampling devices the number of samples which can be taken in this way during a single descent is limited by the size of each sampling device.

Further, the procedure for making use of each sampling device remains lengthy and tedious and is now multiplied by the number of devices to be inserted into the well, and this may not be acceptable for a well which is in production.

SUMMARY OF THE INVENTION

One object of the invention is to provide a sonde in which fluid samples are taken using means which are highly simplified relative to existing sondes (the liquid-containing chamber, the air chamber, the trigger device, and the regulator are all omitted), said means being easy to put into operation in a very short period of time.

Another object of the invention is to provide a sonde which is modular in design, enabling a practically unlimited arbitrary number of fluid samples to be taken in a single descent.

According to the invention, this result is obtained by means of a sonde for taking fluid samples, the sonde including at least one sampling device, each sampling device comprising a tubular body, a suction piston slidably mounted inside said tubular body in such a manner as to delimit a sampling chamber, an admission orifice formed through the tubular body to admit fluid into the sampling chamber, and means for displacing the suction piston inside the tubular body, characterized by the fact that the means for displacing the suction piston comprise a control rod which passes freely through the suction piston, and clutch means for coupling said rod to the suction piston prior to taking a sample, and then for decoupling said rod from the suction piston once the sample has been taken.

Preferably, the control rod is oriented axially relative to the suction piston, and is capable of moving in a direction along its axis under the action of actuator means housed in a tubular body connected to the tubular body of an adjacent sampling device.

For the purpose of taking an arbitrary number of samples during a single descent, a sonde in accordance with the invention generally comprises a plurality of identical sampling devices disposed end-to-end, with the tubular bodies and the control rods of these devices being interconnected by disconnectable connection means.

Preferably, each clutch means couples the rod to the suction piston under the effect of the corresponding suction piston being displaced from an initial, neutralized or standby position into a ready position.

The member fixed on the tubular body of a sampling device situated at the end of the sonde then serves to move the suction piston corresponding to said device into the ready position, thereby enabling it to be actuated by the control rod. Once said end device has been actuated, its suction system serves in turn to bring the suction piston of the adjacent device into the ready position, such that the latter piston can be displaced in turn by the control rod. Successive displacements of the control rod thus serve to actuate all of the sampling devices in the sonde in turn.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
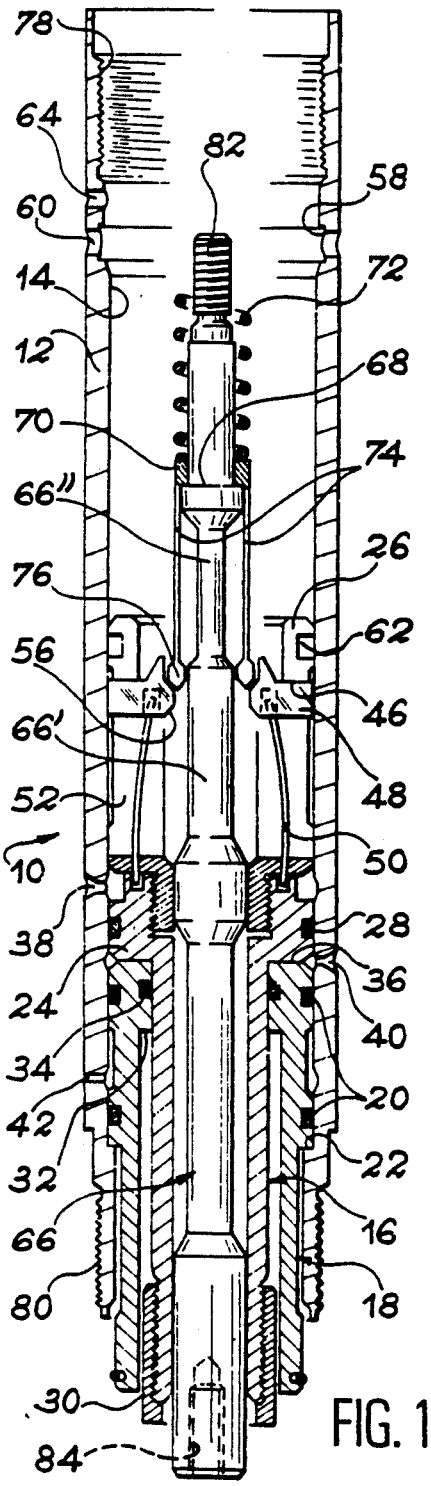
FIG. 1 is a longitudinal section showing a modular sampling device designed to be used in a sonde in accordance with the invention.

With reference to FIG. 1, the description begins with a sampling device constituting the basic building block of a sonde in accordance with the invention. As shown below, this device is modular in design, thereby enabling an arbitrary number of sampling devices to be connected end-to-end, with said number being practically unlimited and depending essentially on the intended utilization. It is also shown below that these devices are controlled by a single actuator device which constitutes another building block of the sonde.

The FIG. 1 sampling device is given an overall reference 10 and comprises a tubular-shaped length of sonde body 12. The length of sonde body 12 has a bore 14 in which a suction piston 16 and a closure piston 18 are slidably mounted in sealed manner.

More precisely, the closure piston 18 is annular in shape and it has two annular grooves in its outside peripheral surface in which two annular gaskets 20, e.g. O-rings, are received and come into sealing contact with the inside surface of the bore 14.

Before the sampling device is used, a shoulder formed on the piston 18 bears against a shoulder 22 formed in the bore 14. This shoulder 22 faces upwardly when the sonde is inserted into a well. The bottom end of the closure piston 18 then projects downwardly beyond the bottom end of the length of sonde body 12, as shown in FIG. 1. In this initial position of the piston 18, the device 10 is neutralized as explained below.

The suction piston 16 is also annular in shape. It comprises a first part 24 constituting the piston per se, and a second part 26 which is screwed into the part 24 and which is described below with reference to FIG. 2.

The part 24 is mounted in the bore 14 immediately above the piston 18 and it has an annular groove in its outside peripheral face in which an annular gasket 28, e.g. an O-ring, is received and comes into sealing contact with the inside surface of the bore 14. The part 24 extends downwardly inside the closure piston 18 in the form of a tubular portion whose bottom end has a sleeve 30 screwed thereon suitable for coming into abutment against a downwardly directed shoulder 32 formed inside the piston 18. An annular sealing gasket 34, e.g. an O-ring, is mounted above said shoulder 32 in a groove formed on the inside of the piston 18. The gasket 34 is in sealing contact with the outside surface of the tubular portion of the part 24.

The gaskets 20, 28, and 34 thus delimit a fluid sampling chamber 36 between the pistons 16 and 18 and the length of sonde body 12. Before the device is used, and as shown in FIG. 1, the suction piston 16 occupies an initial low position in which it bears against the closure piston 18. The volume of the sampling chamber 36 is then practically nil.

Under these conditions, a sampling orifice 38 formed through the side of sonde body 12 opens out into the bore 14 immediately above the part 24. Passages 40 and 42 also formed through the sonde body 12 then open out into the bore 14 respectively between the part 24 and the piston 18, and between the two gaskets 20 on the piston 18.

Figure 2:
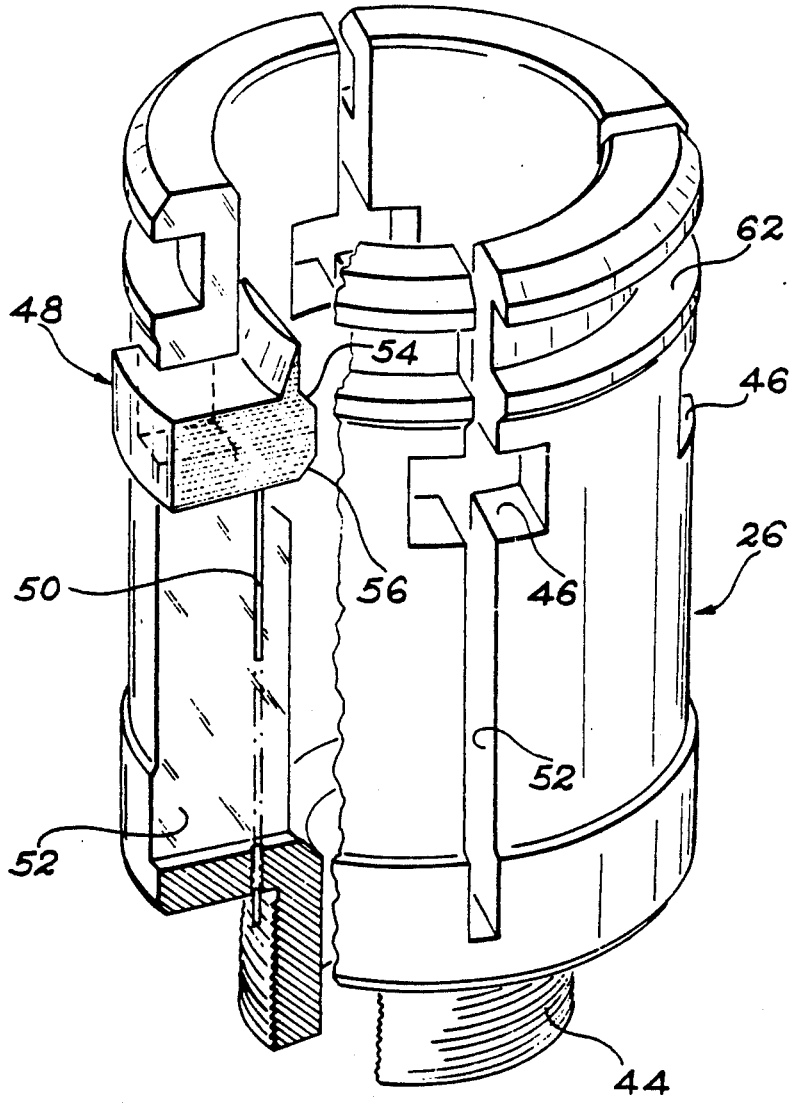
FIG. 2 is a partially cut-away perspective view of a part fixed to the suction piston of the FIG. 1 sampling device, and showing the locking fingers which fix the piston in the sonde body when a sample has been taken.

The part 26 is generally in the form of a circular sleeve, as shown in FIG. 2. The smaller diameter bottom end 44 of said part 26 is threaded to enable it to be screwed into a tapping formed at the top end of the part 24. These two parts thus behave like a single piston 16.

The part 26 has hollows 46 of rectangular shape passing therethrough and distributed circumferentially at the same level close to its top end. Each of these hollows 46, which may be four in number, for example, receives a locking finger 48 suitable for sliding in a radial direction relative to the part 26. Each locking finger 48 is pressed against the inside surface of the bore 14 by a resilient member. In the embodiment shown, this resilient member is a wire spring 50 of the piano wire type and it extends approximately parallel to the axis of the part 26 having its top and bottom ends respectively received in a hole formed in the corresponding finger 48 and a hole formed in the parts 24 and 26. Each of the springs 50 is free to move in a radial direction by virtue of longitudinally extending slots 52 formed in the part 26 and opening out into the hollows 46.

The radially inwardly directed portion of each finger 48, which projects into the inside of the part 26 so long as the finger 48 is bearing against the inside of the bore 14, has a chamfered top surface 54 and a chamfered bottom surface 56 constituting an abutment surface which is used for displacing the suction piston 16 upwardly, as described below.

A groove 58 is formed in the top portion of the bore 14. The width of this groove is practically equal to the height of each of the fingers 48 such that when the suction piston 16 arrives at the top of the length of sonde body 12, the fingers 48 are automatically inserted into the groove 58 by the springs 50, thereby locking the piston 16 in its final position for filling the chamber 36. Holes 60 formed in the sonde body 12 open out into the base of the groove 58. These holes 60 serve to apply hydrostatic pressure to the top surface of the suction piston 16.

Above the hollows 46, the part 26 has a relatively deep annular groove 62 in its outside peripheral surface. When the fingers 48 are locked in the grooves 58, at least one hole 60 formed in sonde body 12 faces said groove 62.

In addition to the length of sonde body 12 and the pistons 16 and 18, each sampling device 10 includes a length of control member 66, as shown in FIG. 1.

This length of control member 66 is constituted by a cylindrical rod extending along the axis of the length of sonde body 12 and suitable for moving along said axis independently of the pistons 16 and 18. Cylindrical bearing surfaces formed inside the parts 24 and 26 of the piston 16 serve to guide the rod 66.

The top portion of the rod 66 situated above a shoulder 68 supports a ring 70. The ring is urged against the shoulder 68 by a helical compression spring 72 surrounding the rod 66 above the ring. Spring blades 74 have their top ends fixed to the ring 70 and extend downwardly in directions approximately parallel to the axis of the rod. The bottom ends of the spring blades 74 carrying fingers 76 having approximately hexagonal cross-sections in radial planes passing through the axis of the rod. The assembly formed by the ring 70, the spring blades 74, and the fingers 76 constitutes a drive part.

When the ring 70 bears against the shoulder 68, the fingers 76 are level with a relatively large diameter portion 66' of the rod 66, thereby preventing the fingers from moving inwardly. The fingers 76 then press against the surfaces 54 or the surfaces 56 of the fingers 48, depending on whether they are located above or below said fingers 48.

Before the device is used, the fingers 76 are above the fingers 48 as shown in FIG. 1. Under such circumstances, an upwards displacement of the rod 66 displacing the assembly constituted by the ring 70, the spring blades 74, and the fingers 76 in the same direction has no effect on the pistons 16 and 18.

In contrast, when the pistons 16 and 18 are in a slightly higher, "ready" position inside the length of sonde body 12 (which ready position is reached in a manner described below), the fingers 76 are below the fingers 48. As a result, upwards displacement of the rod 66, the ring 70, the spring blade 74, and the fingers 76 then drives the piston 16 in the same direction.

The assembly constituted by the ring 70, the spring blade 74, and the fingers 76 is also capable of moving upwardly along the rod 66 by compressing the spring 72. The fingers 76 then come level with a portion 66'' of the rod 66 which is smaller in diameter than the portion 66'. The fingers 76 can then retract radially inwardly in order to move past the fingers 48 during relative displacement between the rod 66 and the piston 16.

As mentioned above, the sampling device 10 is modular in design, i.e. it is designed in such a manner that an arbitrary number of identical sampling devices can be disposed end-to-end.

For this purpose, FIG. 1 also shows that the top end of each length of sonde body 12 has an internal tapping 78 suitable for screwing onto a thread 80 formed on the bottom end of an adjacent length.

Similarly, each length of the control member has a thread 82 at its top end suitable for screwing into tapping 84 formed at the bottom end of an adjacent length. The distance between the thread 82 and the tapping 84 on a length 66 is equal to the distance between the thread 80 and the tapping 78 on a length 12.

Figure 3:
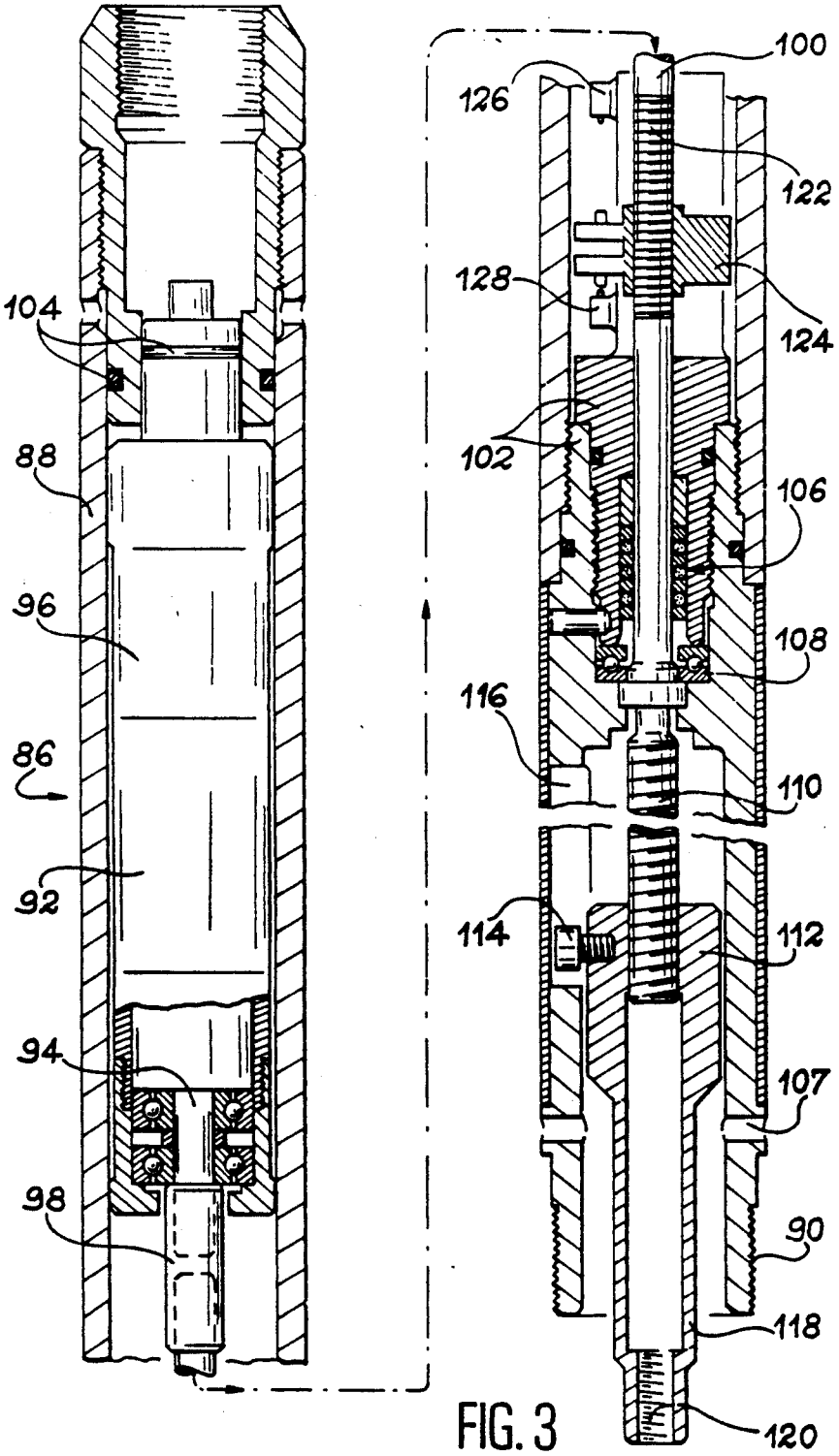
FIG. 3 is a longitudinal section through an actuator device designed to be associated with one or more modular sampling devices, in accordance with the invention.

The, or each, sampling device 10 of a sonde is controlled by imparting a back-and-forth motion to the control member constituted by all of the lengths 66 connected end-to-end along the axis of said member, as described in greater detail below. In order to move the control member in this way, the sampling sonde also includes, in addition to the device(s) 10, an actuator device 86 suitable for fixing above the sampling device(s). The actuator device 86 is now described with reference to FIG. 3 with the lefthand and righthand sides of FIG. 3 showing the top and bottom portions respectively of said device.

The actuator device 86 comprises a length of sonde body 88 which is tubular in shape and which has the same diameter as the lengths of sonde body 12 of the sampling devices 10. The bottom end of the length of sonde body 88 has a thread 90 identical to the threads 80 of the lengths 12. The length 88 can thus be screwed into the adjacent length 12, thereby providing a disconnectable connection between these two lengths of sonde body.

The top portion of the length of sonde body 88 contains an electric motor 92 whose outlet shaft 94 is downwardly directed and lies on the axis of the sonde body. The motor 92 may be equipped with a stepdown gear unit and it is driven electrically from the surface by means of a conventionally designed electronic connection module 96 which does not form part of the invention.

Beneath the motor 92, the shaft 94 drives a cylindrical rod 100 disposed along the axis of the sonde body in rotation by means of a coupling 98. The rod 100 passes through a part 102 which is screwed in sealed manner to the inside of the length of sonde body 88 and which separates a top zone of said length from a bottom zone, with the top zone being isolated in sealed manner from the outside and under atmospheric pressure, while the bottom zone is in communication with the outside. The top zone is confined relative to the outside above the electronic interconnection module 96 by means of sealing gaskets 104 and below the motor 92 it is confined by means of packing 106. Holes 107 formed through the length of sonde body 88 put the bottom zone into communication with the outside atmosphere. A ball abutment 108 interposed between the rod 100 and the part 102 enable the rod to withstand the high pressure differences which exist between the two zones when the sonde is downhole.

Beneath the part 102, the rod 100 has a threaded portion 110 with a nut 112 screwed thereon and prevented from rotating inside the length of sonde body 88 by a finger 114 which is received in an axial groove 116 formed therein. The nut 112 extends downwardly along the axis of the sonde to constitute a top length 118 of the control member. This length 118 is in the form of a cylindrical rod and is terminated by tapping 120 identical to the tapping 84 of the lengths 66, thereby enabling the top length 118 to be screwed onto the length of control member 66 of the sampling device 10 situated immediately beneath the actuator device 86.

By virtue of the above-described disposition, the effect of causing the motor 92 to rotate in one direction or the other is to raise or lower the control member at a slow speed.

In order to limit the up and down stroke of the control member, the rod 100 has a second threaded portion 122 between the coupling 98 and the part 102. A carriage 124 screwed onto said threaded portion 122 is prevented from rotating inside the length of sonde body 88. Under the effect of the axial displacement of the carriage 124 caused by rotation of the rod 100, this carriage serves to actuate a top end-of-stroke contact 126 and a bottom end-of-stroke contact 128, both fixed inside the length 88.

The operation of a sampling sonde in accordance with the invention and comprising a plurality of sampling devices disposed end-to-end and surmounted by an actuator device, is now described in detail with reference to FIGS. 4*a* to 4*f*.

FIGS. 4*a* to 4*f* show the bottom end of a sampling sonde including at least three sampling devices. In order to identify these devices and their component parts, the reference numerals are given the indices a, b and c going up from the bottom. These sampling devices 10*a*, 10*b*, and 10*c*, may be practically unlimited in number and they are surmounted by the above-described actuator device 86. The lengths of sonde body and the lengths of control member in all of these devices are screwed to one another so as to form a single sonde body and a single control member.

Figure 4A:
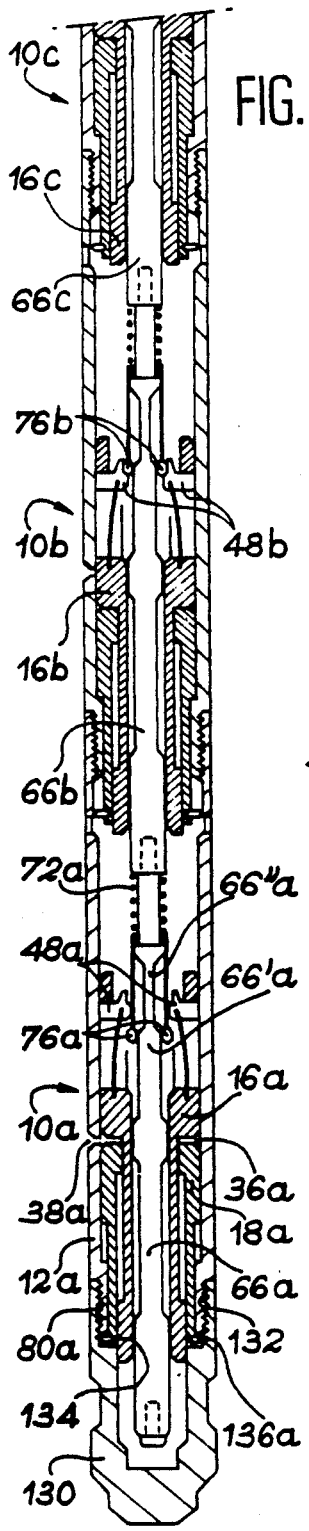
FIGS. 4*a* to 4*f* are diagrammatic longitudinal section views on a smaller scale showing a plurality of modular sampling devices disposed end-to-end at various different moments during actuation thereof.

As shown in FIG. 4*a*, before inserting the sonde into a well, a bottom end piece 130 provided with tapping 132 at its top end is screwed onto the thread 80*a* of the length of sonde body 12*a* of the bottom-most sampling device 10*a*. A shoulder 134 formed in the end piece 130 then bears against the bottom end of the piston 18*a*, thereby simultaneously displacing both of the pistons 18*a* and 16*a* through a given upwards direction inside the length of sonde body 12*a*.

During this displacement, the length of control member 66*a* does not move and it occupies a low position as shown in FIG. 1. The effect of raising the pistons 18*a* and 16*a* is thus to push the fingers 76*a* upwardly, thereby compressing the spring 72*a*, until the fingers come level with the smaller diameter portion 66″*a*. They then move radially inwardly and allow the fingers 48*a* carried by the piston 16*a* to pass. The spring 72*a* then returns the fingers 76*a* downwardly and they spread apart again when they come level with the larger diameter portion 66′*a*.

Thus, at the end of the upwards displacement of the pistons 16*a* and 18*a* due to installing the end fitting 130, the fingers 48*a* of the bottom sampling device 10*a* are located above the fingers 76*a* of the control member, whereas the fingers 48*b*, etc. of the other sampling devices 10*b* etc. are still beneath the corresponding fingers 76*b* etc. of the control member. In this position, shown in FIG. 4*a*, the suction piston 16*a* of the bottom device 10*a* occupies an intermediate or "ready" position, whereas the suction pistons 16*b*, 16*c*, etc. in the other sampling devices are still in their neutralized initial positions.

While the pistons 16*a* and 18*a* are in this intermediate ready position, the sampling chamber 36*a* formed between said pistons and whose volume is still practically nil, is in communication with the outside via the orifice 38*a*, while the other holes through the sonde body put each of the sealing gaskets associated with the pistons 16*a* and 18*a* under conditions of pressure equilibrium. In addition, a washer 136*a* constituting a member for braking the piston 18*a* and received in a groove formed at the bottom end thereof comes flush with the bottom end of the length of sonde body 12*a*.

When the sonde is lowered down a well and reaches a depth corresponding to the first sample to be taken, the motor 92 is controlled from the surface to rotate in the direction corresponding to raising the control member constituted by the lengths 66*a*, 66*b*, 66*c*, etc., 118 inside the sonde body.

Such raising of the control member has no effect on the sampling devices 10*b*, 10*c*, etc. since the fingers 76*b*, 76*c*, etc. are above the fingers 48*b*, 48*c*, etc.

Figure 4B:
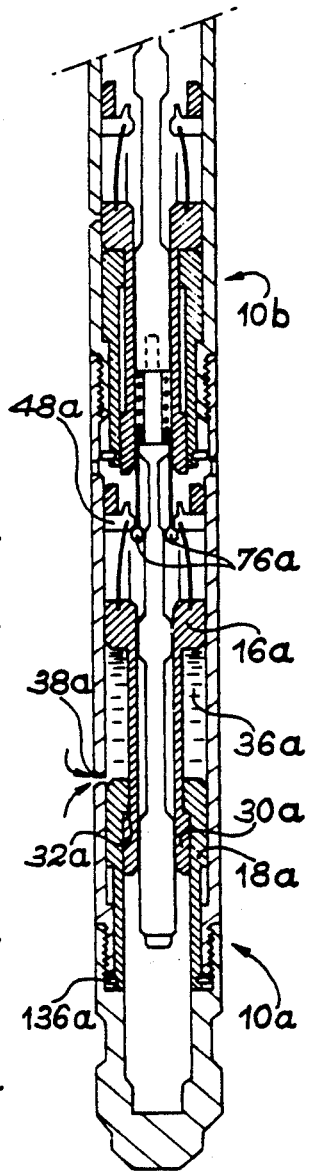

However, as shown in FIG. 4*b*, raising the control member causes the suction piston 16*a* of the bottom sampling device 10*a* to rise since the fingers 76*a* are beneath the fingers 48*a*. Meanwhile, the piston 18*a* remains stationary by virtue of the washer 136*a* cooperating with the inside surface of the sonde body. Consequently, the sampling chamber 36*a* fills progressively with the fluid present outside the sonde by suction through the orifice 38*a*.

It should be observed that the time taken to fill the sampling chamber 36*a* is determined by the speed of the motor 92 and is independent of pressure since the piston 16*a* is under pressure equilibrium conditions.

Figure 4C:
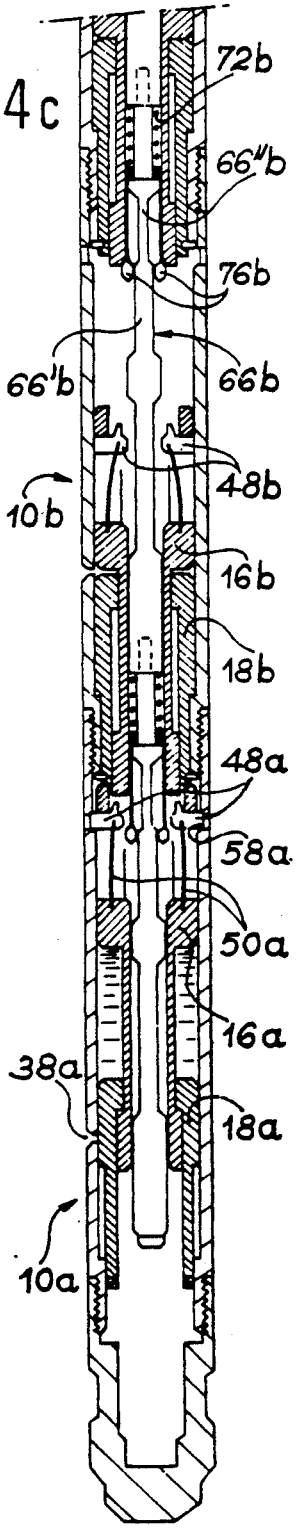

When the volume of fluid present in the chamber 36*a* reaches the desired value, i.e. about 50 cc, for example, the sleeve 30*a* fixed to the piston 16*a* bears against the shoulder 32*a* of the piston 18*a* (FIG. 4*b*). The two pistons 16*a* and 18*a* then move upwardly together as shown in FIG. 4*c*.

This displacement of the closure piston 18*a* closes the orifice 38*a* between the two gaskets mounted on the periphery of the piston 18*a*. The sampling chamber 36*a* containing a fluid sample of determined volume is thus isolated from the outside in the same manner as in a conventional sampling sonde.

Further, at the end of its upwards displacement, the suction piston 16*a* comes into abutment at its top end against the bottom end of the closure piston 18*b* of the adjacent sampling device 10*b*. The piston 16*a* thus pushes the pistons 18*b* and 16*b* of the sampling device 10*b* into their intermediate ready position which is identical to that previously occupied by the pistons 18*a* and 16*a* as shown in FIG. 4*a*.

The end of the upwards stroke of the control member is determined by the top end-of-stroke contact 126 (FIG. 3), which stops the motor 92. The locking fingers 48*a* are then level with the groove 58*a* and they are inserted into the groove by the spring blades 50*a*, as shown in FIG. 4*c*. The suction piston 16*a* is thus locked inside the sonde body in its final or full position.

In order to prepare the sonde to take another sample, the control member is lowered again by operating the motor 92 in the opposite direction.

During this displacement, the fingers 76*b* associated with the length of control member 66*b* come into abutment against the fingers 48*b* associated with the piston 16*b*. Thus, the fingers 76*b* are raised against the force of the spring 72*b* until they come level with the smaller diameter portion 66″*b*, whereupon they retract radially inwardly in order to move past the fingers 48*b*, after which they spread out again and come level with the portion 66′*b*, under the effect of the spring 72*b* as shown in FIG. 4*d*.

Figure 4D:
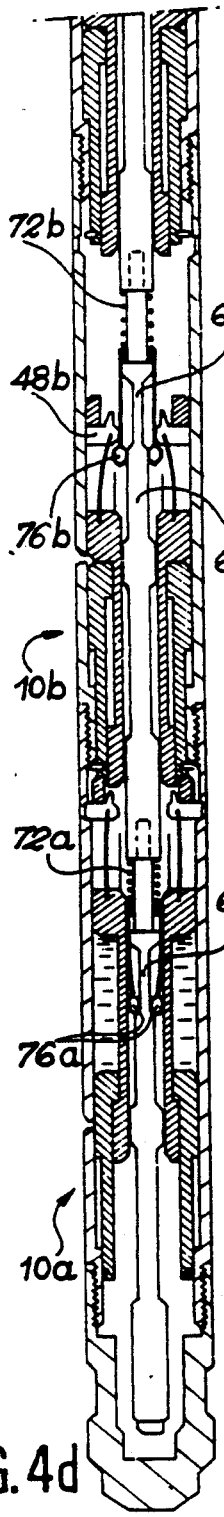

As the control member moves down, the fingers 76*a* move upwards against the spring 72*a* and they retract into the small diameter portion 66″*a*, as also shown in FIG. 4*d*. Otherwise, the other fingers 76*c* etc. remain above the corresponding fingers 48*c* etc.

Under these conditions, a new sample can be taken using the sampling device 10*b* situated immediately above the bottom sampling device 10*a* which has already been used for taking a first sample of fluid. When the sonde reaches the desired depth, this sample is taken in the same manner as the preceding sample by actuating the motor 92 in the appropriate direction for raising the control member inside the sonde body.

Figure 4E:
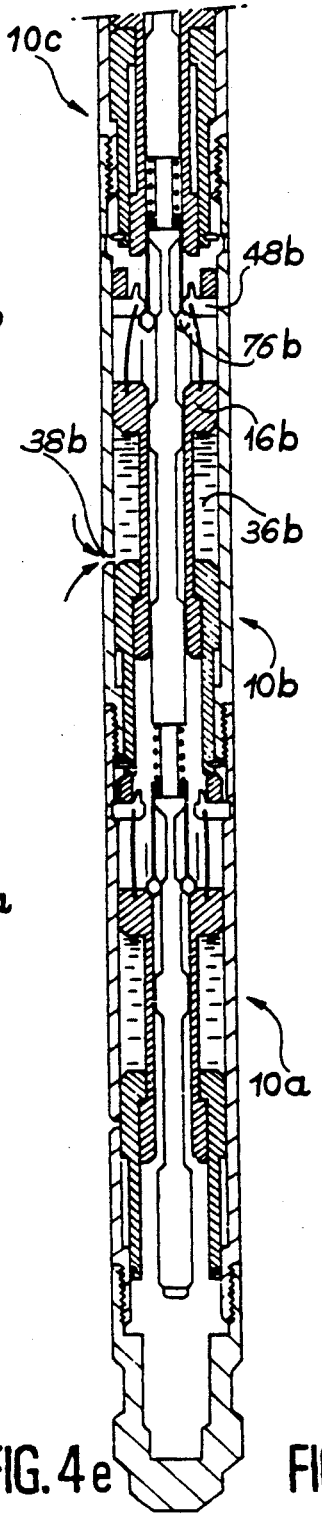
Figure 4F:
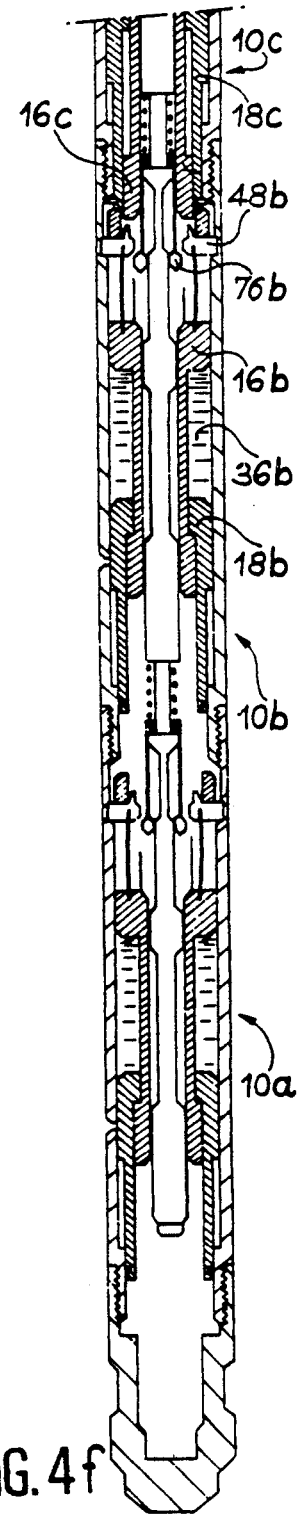

As shown by FIGS. 4*e* and 4*f* in succession, this upwards displacement of the control member has no effect on the sampling devices 10*a*, 10*c*, etc. However, it does drive the suction piston 16*b* of the sampling device 10*b* since the fingers 72*b* associated with the control member are engaged against the fingers 48*b* associated with the piston 16*b*. A second sample is thus taken via the orifice 38*b* into the chamber 36*b*.

As when using sampling device 10*a*, at the end of its stroke, the piston 16*b* entrains the piston 18*b*, thereby cutting off communication between the sampling chamber 36*b* and the outside. In addition, piston 16*b* pushes the pistons 18*c* and 16*c* upwardly, thereby bringing these pistons to their intermediate ready position. After the control member has moved back down again, the sonde is ready to take another sample using device 10*c*.

It will be understood that the operations described above for the two sampling devices 10*a* and 10*b* can be repeated as often as necessary in order to take as many fluid samples as the sonde has sampling devices 10 assembled end-to-end, merely by causing the control member to move up and down in alternation under the control of the actuator device 86.

In the above-described sampling sonde, sampling is controlled by means which are purely mechanical, such that the liquid chamber, the chamber of air under pressure, the trigger device, and the regulator device used in all existing sondes are omitted. Preparation and use of the sonde is thus greatly simplified and shortened.

Further, when the sonde comprises a plurality of modular sampling devices placed end-to-end as in the above-described example, it is possible to take a practically unlimited number of samples in succession during a single descent.

Further, the sonde of the invention is designed to satisfy the safety requirements imposed by the very high pressures of the samples taken, to guarantee accurate knowledge of the volumes of these samples, to ensure easy and reliable transfer of these samples to an analysis laboratory, and to make it easy to perform the desired measurements and analyses.

Figure 5:
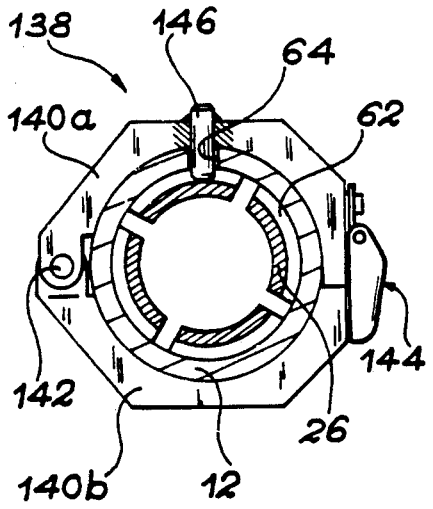
FIG. 5 is a plan view showing a safety collar for temporarily locking each suction piston in place in the corresponding length of sonde body once the sonde is brought back to the surface.

Thus, when the sonde is raised to the surface, a collar such as the collar 138 of FIG. 5 is placed on each of the sampling devices 10*a*, 10*b*, etc. of the sonde.

Each collar is placed around the length of sonde body 12 of the corresponding device level with the holes 64 facing the groove 62 in the part 26.

Each of the collars 138 is constituted, for example, by two half-shells 140*a* and 140*b* which are hinged to each other about an axis 142 located at one of their ends. A toggle mechanism 144 serves to open and close the collar. One of the half-shells (140*a* in FIG. 5) includes a peg 146 which projects radially inwardly. By penetrating into one of the holes 64 in the groove 62, the peg 146 reliably locks the suction piston 16 in place inside the sampling device.

Once all of the collars 138 have been put into place, the various sampling devices 10 constituting the sonde can be disassembled without danger for personnel. The rod 66 constituting the length of control member in each device is extracted from the device and plugs 148 and 150 are screwed onto opposite ends of the length of sonde body 12 of the device. The top plug 148 is screwed into the tapping 78 and bears against the top end of the piston 16, thereby guaranteeing the safety of personnel during transport. The collars 138 can therefore be removed once the plugs 148 and 150 have been installed.

It should also be observed that a sonde comprising only a small number of sampling devices can be transported without being disassembled. It is also possible to transport groups of two or three devices which remain connected to each other. In addition, removing the lengths of rod 66 is optional.

Figure 6:
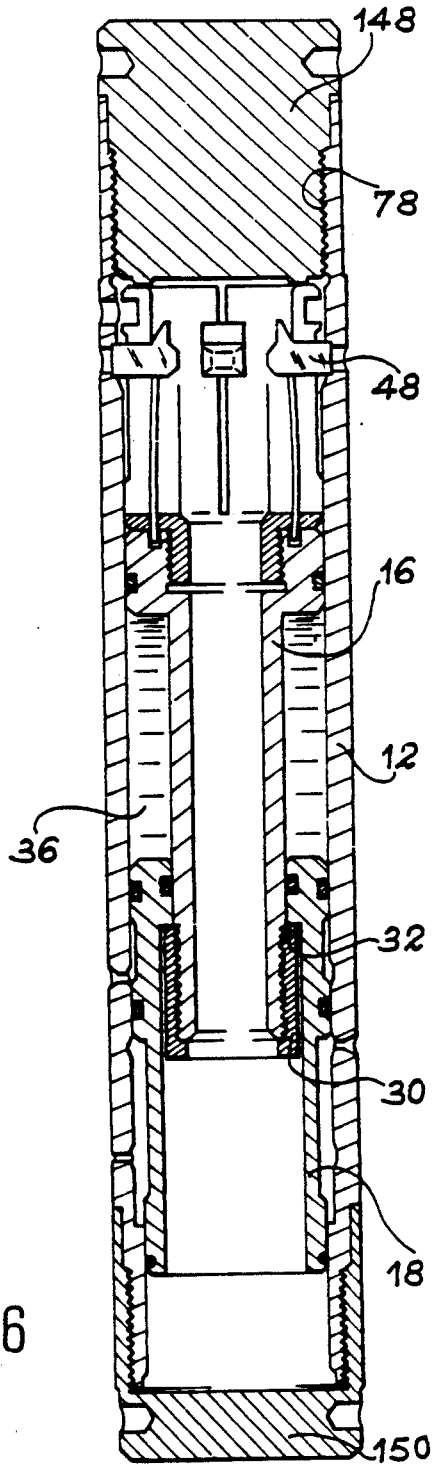
FIG. 6 is a longitudinal section view through a modular sampling device containing a fluid sample and fitted with plugs, with the device being shown in the position which it occupies, for example, while being transferred from a well to an analysis laboratory.

When the sonde is returned to the surface, the pressure inside the sampling chamber 36 is such that the shoulder 32 of the closure piston 18 is pressed against the sleeve 30 fixed to the suction piston 16 (FIG. 6). The volume of fluid occupying the chamber 36 is thus indeed identical to the volume occupied by the fluid when the sample was taken. Given that the sonde is also fitted, in conventional manner, with means for measuring the temperature and the pressure of each location from which a sample is taken, it is possible in the laboratory to reconstitute the exact conditions under which the sampled fluid was taken.

Figure 7:
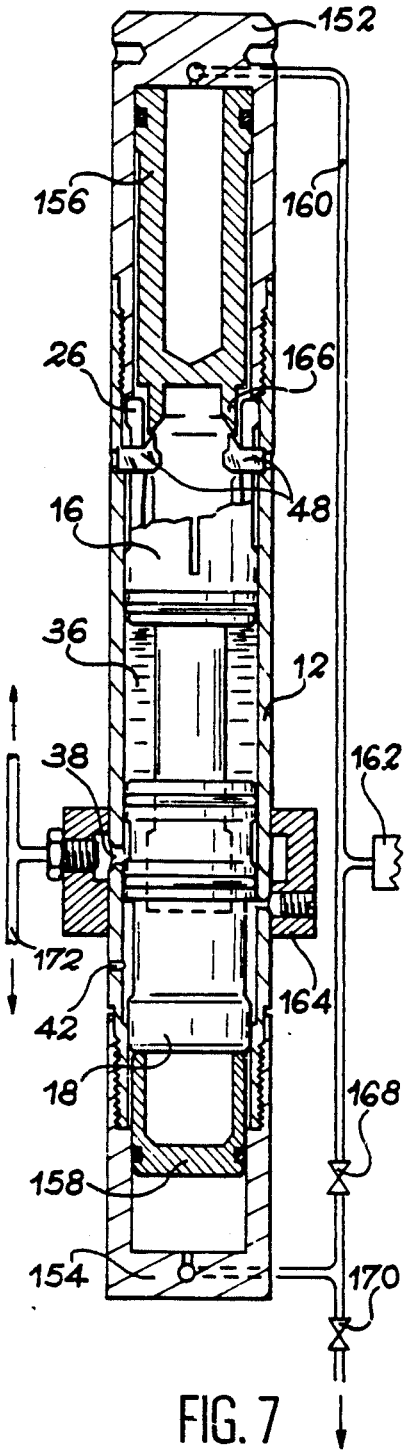
FIG. 7 is a longitudinal section view showing a modular sampling device containing a fluid sample and disposed in an installation for performing various measurements and analyses on the sample.

FIG. 7 shows that the structure of a sonde sampling device in accordance with the invention is well adapted to the measurements and analyses which are normally performed on samples taken from a well.

When each device 10 fitted with its plugs 148 and 150 (FIG. 6) arrives in the laboratory, a collar 138 (FIG. 5) is put back into place as described above for ensuring the safety of laboratory personnel during plug removal.

Two blind cylinders 152 and 154 are screwed onto the length of sonde body 22 instead of the corresponding plugs, said cylinders being suitable for enabling respective pistons 156 and 158 to slide in sealed manner therein. A duct 160 connects the chamber formed between each of the pistons 156 and 158 and the corresponding cylinder 152 and 154 to a source of hydraulic fluid under pressure 162. In addition, a ring 164 is placed around the length of sonde body 22 in order to close the orifice 38 and the hole 40. The collars 138 are then removed since personnel safety is now ensured by the cylinder and piston assemblies 152–156.

The end of the piston 156 facing the part 26 is fitted with a chamfered ring 166 which bears against the slopes formed on the fingers 48 so as to displace these fingers radially inwardly as pressure is increased.

The above-described installation serves to measure the bubble point of the sample contained in the chamber 36.

To this end, the pressure in the cylinders 152 and 154 is raised from the source 162 until it reaches a pressure which is slightly greater than the pressure of the sample when it was taken. A valve 168 in the duct 160 between the source 162 and the cylinder 154 is then closed in order to maintain the above mentioned pressure on the closure piston 18 of the device via the piston 158. Thereafter, the pressure applied to the suction piston 16 by the piston 156 is progressively released so as to plot the curve of variation in the pressure of the sample as a function of its volume. If care is taken to select a piston 156 whose effective area is equal to the annular area of the chamber 36, this curve may be plotted directly. The bubble point corresponds in conventional manner to the discontinuity in the curve.

The installation shown in FIG. 7 can then be used to transfer the sample to an analysis device such as a chromatograph.

To this end, a valve 170 putting the cylinder 154 into communication with a sump is opened. The assembly constituted by the pistons 156, 16, 18, and 158 then moves downwardly under the effect of the pressure in the cylinder 152. The sample contained in the chamber 36 is then level with the orifice 38 and the orifice 38 is connected to one or more analysis apparatuses via duct 172 connected to the ring 164.

Naturally, the invention is not limited to the embodiment described above by way of example, rather it extends to any variant thereof. Thus, the sonde in accordance with the invention could be actuated by a control rod co-operating with each suction piston by means of a clutch of a type different from that which has been described, for example an electromagnetic clutch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A sonde for taking fluid samples comprising: at least one sampling device, each said sampling device comprising a tubular body, a suction piston slidably mounted inside said tubular body in such a manner as to define a sampling chamber behind said suction piston, an admission orifice formed through said tubular body to admit fluid into said sampling chamber, and means for displacing said suction piston inside said tubular body, wherein said means for displacing said suction piston comprise a control rod which passes freely through said suction piston, and clutch means for coupling said control rod to said suction piston prior to taking a sample, and then for decoupling said control rod from said suction piston after the sample has been taken.

2. A sampling sonde according to claim 1 wherein said control rod is oriented axially relative to said suction piston and is capable of moving axially with respect to said sonde.

3. A sampling sonde according to claim 2 further comprising an actuator device comprising actuator means connected to said tubular body of an adjacent sampling device, wherein said actuator means engages said control rod in order to displace said rod along the axis of said sonde.

4. A sampling sonde according to any one of claims 1, 2, or 3 wherein each sampling device further includes a closure piston slidably mounted in said tubular body of said sampling device and cooperating with said tubular body via a braking part wherein said suction piston bears against said closure piston once the sample has been taken in order to displace said closure piston for the purpose of closing said fluid admission orifice.

5. A sampling sonde according to claim 4 wherein said suction piston and said closure piston include sealing gaskets which cooperate with said tubular body of said sampling device, and wherein passages are formed in said tubular body in order to put said gaskets under pressure equilibrium conditions relative to said admission orifice for admitting fluid into said sampling chamber.

6. A sampling sonde according to claim 5, wherein said suction piston has an outer annular groove, said groove being situated, once a sample has been taken, level with at least one hole formed through said tubular body of said sampling device, such that a collar may be fixed onto said tubular body, and wherein said collar includes a peg which then penetrates into said outer annular groove through said hole.

7. A sampling sonde according to claim 6 further comprising locking fingers mounted so as to slide radially through slots in said suction piston and resilient means cooperating with and urging each finger radially outwardly against said tubular body, said tubular body having an inside annular groove into which said locking fingers penetrate once a sample has been taken, thereby locking said closure piston in said position.

8. A sampling sonde according to claim 7 wherein said sonde includes a plurality of identical sampling devices disposed end-to-end with respective tubular bodies, the control rods of said devices being interconnected by disconnectable connection means.

9. A sampling sonde according to claim 8 wherein each clutch means couples said rod to said suction piston of said sampling device whereby said clutch means is displaced from an initial, neutralized position into a ready position.

10. A sampling sonde according to claim 9 wherein said suction piston of one of said sampling devices is situated at one end of said sonde and is displaced from its initial, neutralized position to its ready position by a member fixed to said tubular body of said sampling device by said disconnectable connection means, said suction piston of each of said other sampling devices being displaced from its initial neutralized position to its ready position by said suction piston of said adjacent sampling device once a sample has been taken by said adjacent device.

11. A sampling sonde according to claim 10 wherein said control rod is oriented axially relative to each suction piston and is capable of moving along said axis, and wherein each clutch means comprises a drive part mounted on said control rod in such a manner as to be driven by said control rod when it moves in an actuation direction, and a bearing surface associated with said suction piston of said sampling device containing said clutch means, wherein said bearing surface is brought into engagement with said drive part by said suction piston being displaced from its initial, neutralized position to its ready position.

12. A sampling sonde according to claim 11 wherein each suction piston is an annular piston through which said control rod passes coaxially, said drive part comprising a ring mounted on said rod and urged by resilient means against a shoulder formed thereon, and at least one finger suitable for bearing against said bearing surface and connected to said ring by a spring blade oriented approximately parallel to the axis of said rod, said finger bearing against a relatively large diameter portion of said rod when said ring is pressed against said shoulder, and being capable of withdrawing towards a smaller diameter portion of said rod when said ring is moved away from said shoulder.

13. A sampling sonde according to claim 12 wherein said bearing surface is formed on said locking fingers.

14. A sampling sonde according to claim 13 wherein said disconnectable connection means comprise threaded portions and tapped portions suitable for being screwed together.

15. A sampling sonde according to claim 14 further comprising at least one transport plug which may be screwed onto said tubular body of each sampling device after said connection means have been disassembled.

* * * * *